US006003461A

United States Patent [19]

Blanchette et al.

[11] Patent Number: 6,003,461

[45] Date of Patent: Dec. 21, 1999

[54] QUICK-ACTING, WATER-TIGHT COMPOSITE DOOR ASSEMBLY

[75] Inventors: Brian D. Blanchette; Garland E. Borowski, both of Mobile, Ala.; Edward C. Dunston; Edward T. Gaines, both of Gautier, Miss.; Michael D. Hodges, Safety Harbor, Fla.; William R. Mack, Moss Point; John W. Whitehead, Lucedale, both of Miss.

[73] Assignee: Ingalls Shipbuilding, Inc., Pascagoula, Miss.

[21] Appl. No.: 08/988,780

[22] Filed: Dec. 11, 1997

[51] Int. Cl.[6] ..... B63B 19/00

[52] U.S. Cl. ..... 114/117

[58] Field of Search ..... 114/78, 117, 173, 114/201 R; 49/475.1, 483.1

[56] References Cited

U.S. PATENT DOCUMENTS

| | | | |
|---|---|---|---|
| 2,511,267 | 6/1950 | Jacob | 114/117 |
| 2,511,268 | 6/1950 | Schiff | 114/117 |
| 5,199,369 | 4/1993 | Meyer et al. | 114/201 R |

*Primary Examiner*—Stephen Avila

*Attorney, Agent, or Firm*—Scott J. Coonan, Esq.

[57] ABSTRACT

A door assembly includes a main door body with an interior flange and an exterior flange, both extending parallel and generally away from the main door body. A door frame surrounds the door body when the latter is in a closed position, the door frame having an inner and outer flange, both of the latter extending generally toward the main door body when in its closed position. Two gaskets are provided between a flange of the door frame and a flange of the door, whereby movement of the main door body in a given direction generally perpendicular to the direction in which the flanges extend causes the gasket to be compressed. One of the flanges of the door has a plurality of spaced-apart compression members, for each of which a latch member is provided, each latch member having a pressure component and being mounted to the door frame for movement between a first position in which the pressure component presses against the respective compression member in the direction which compresses the gasket, and a second position in which the pressure component does not press against the compression member. Finally, a linkage assembly interconnects all latch numbers and moves them in tandem between their respective first and second positions. The linkage assembly includes operating means for operating the linkage assembly.

20 Claims, 17 Drawing Sheets

Figure 21
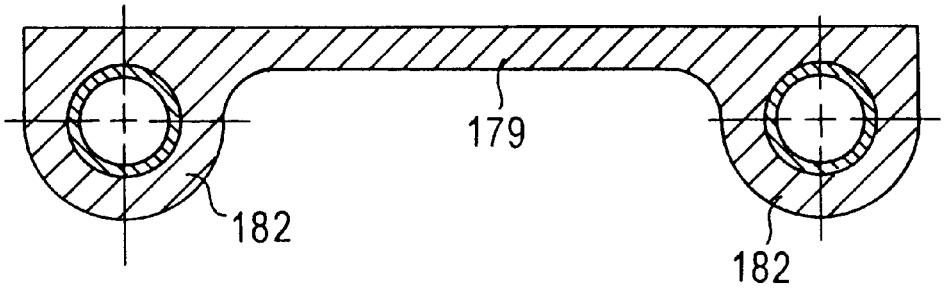
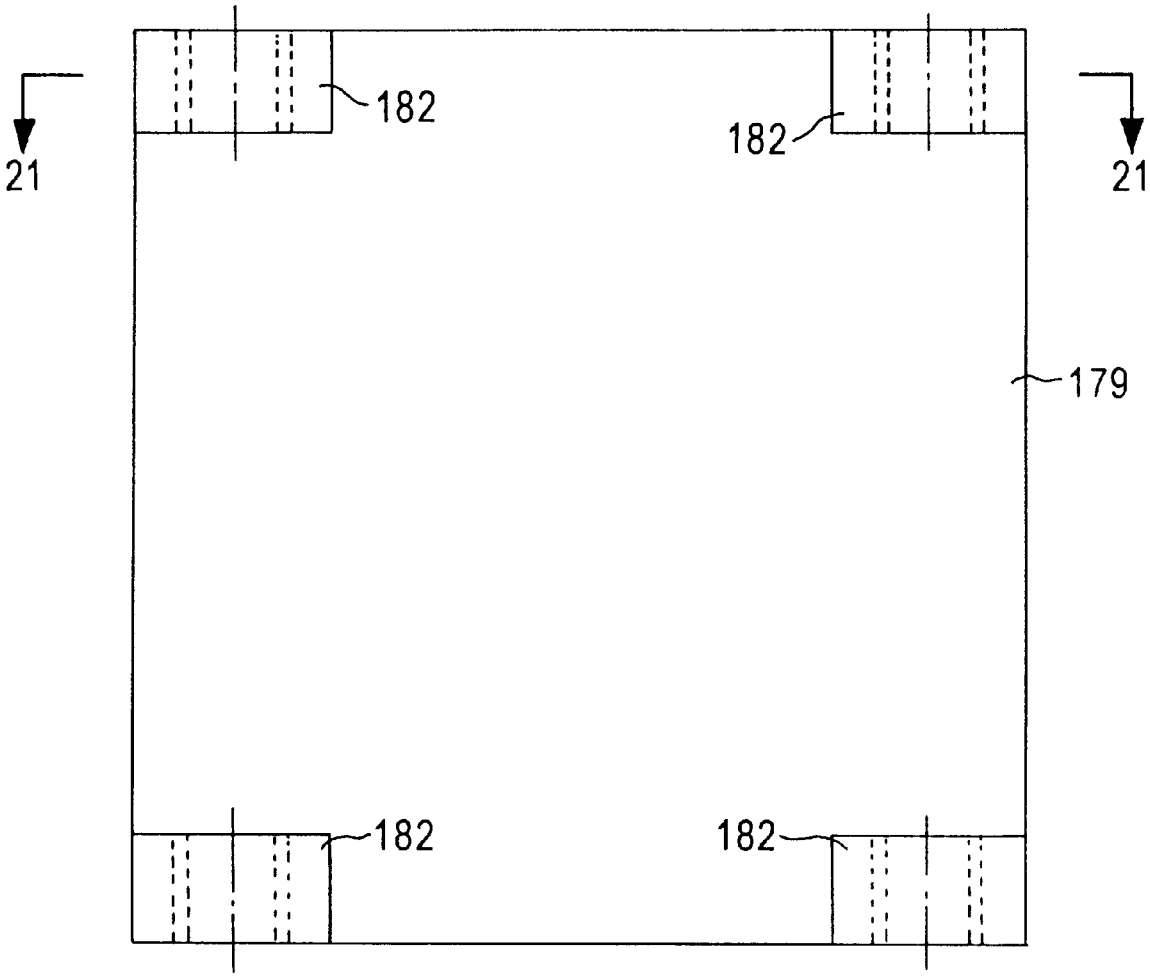
Figure 20

QUICK-ACTING, WATER-TIGHT COMPOSITE DOOR ASSEMBLY

This invention relates generally to the construction of air-tight and water-tight doors of the kind used in various types of vessels, particularly in bulkheads.

BACKGROUND OF THIS INVENTION

The standard steel door used for sea-going vessels, while relatively economical to produce, has several shortcomings. It has poor stealth characteristics, is susceptible to corrosion, and loses water-tight integrity due to warping of the bulkhead and the knife-edge gasket set. Previous attempts to remedy the disadvantages of the standard door have merely exchanged one drawback for another. One such door has an improved radar cross-section (RCS), structural integrity and appearance, however it is heavier and more expensive than the standard door. Other alternative constructions have also proven to be heavy, expensive, difficult to fabricate and/or difficult to install.

OBJECTS OF THIS INVENTION

Accordingly, one object of this invention is, in general terms, to develop a quick acting water-tight composite door design which surpasses doors currently available.

Another object of this invention is to provide a water-tight door with excellent RCS characteristics.

Yet another object of this invention is to provide a water-tight door which will retain its water-tight integrity even after the adjoining bulkhead has warped.

Yet another object of this invention is to provide a water-tight door which is intrinsically resistant to corrosion.

Another object of this invention is to provide a door which is lighter and more reliable than the other alternatives.

Finally, an object of this invention is to provide a combination of components and sub-components that will generate a door assembly whose primary function is to prevent water penetration through a bulkhead opening while enabling rapid manual actuation of the door access.

GENERAL DESCRIPTION OF THIS INVENTION

In order to achieve the foregoing goals, one embodiment of this invention includes a door assembly having a main door body and a first peripheral member of substantially constant section extending around the perimeter of the main door body. The first peripheral member defines interior and exterior flanges, both of which extend generally away from the main door body. The assembly further includes a second peripheral member in the form of a door frame adapted to surround the door body when the latter is in a closed position, the door frame having an inner flange and an outer flange, both of which extend generally toward the main door body when the latter is in a closed position. The embodiment further includes gasket means to be used between a flange of the first peripheral member and a flange of the second peripheral member, such that movement of the main door body in a given direction generally perpendicular to the direction in which the inner and outer flanges extend causes compression of the gasket means. The combination further includes a plurality of spaced-apart compression members secured to one of the flanges of one peripheral member, and, for each compression member, a latch member having a pressure component, the latch member being mounted on the other peripheral member for movement between (1) a first position in which the pressure component presses against its respective compression member in a direction tending to move the main door body in said given direction, thus compressing the gasket means and (2) a second position in which the pressure component does not press against its respective compression member. Finally, the combination includes a linkage assembly interconnecting all latch members and adapted to move the latch members in tandem between their respective first and second positions, the linkage assembly including operating means for operating the linkage assembly.

A further embodiment of this invention provides a door assembly comprising: a main door body; a first peripheral member extending around the perimeter of said main door body and secured thereto, said member defining a door flange extending generally away from the main door body; a second peripheral member in the form of a door frame adapted to surround the door body when the latter is in a closed position, the door frame defining a frame flange extending generally toward the main door body when the latter is in said closed position; a gasket between said two flanges, such that movement of the main door body in a given direction generally normal to the plane of the main door body causes compression of the gasket means, a plurality of spaced-apart compression members secured to one of the flanges; for each compression member, a latch member having a pressure component, the latch members being mounted on the other flange for movement between 1) a first position in which the pressure component presses against its respective compression member in a direction tending to move the main door body in said given direction, thus compressing the gasket means, and 2) a second position in which the pressure component does not press against its respective compression member; and a linkage assembly interconnecting all latch members and adapted to move the latch members in tandem between their respective first and second positions, the linkage assembly including operating means for operating the linkage assembly; each latch member including:

- a latch pin mounted on said other flange,
- a rotary member mounted on said latch pin for axial movement therealong and for rotation thereabout,
- a pressure arm fixed to and extending radially away from the rotary member, the pressure arm supporting said pressure component,
- linkage arm means fixed to and extending radially away from the rotary member,
- resilient means urging the rotary member to slide along the latch pin in the direction opposite said given direction, and
- spacer means establishing a limit to such sliding movement of the rotary member.

GENERAL DESCRIPTION OF THE DRAWINGS

Several embodiments and variants of this invention are illustrated in the accompanying drawings, in which like numerals denote like parts throughout the several views, and in which.

Figure 1A:
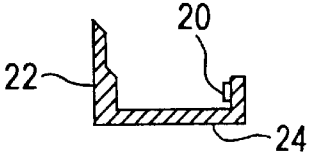
FIG. 1A is a sectional view taken through one of the FIG. 1 components at the line A—A.
Figure 1B:
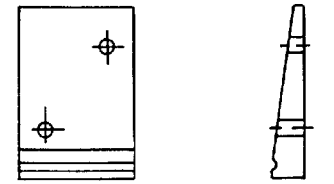
FIG. 1 is an exploded view of the components of a composite door.
Figure 1:
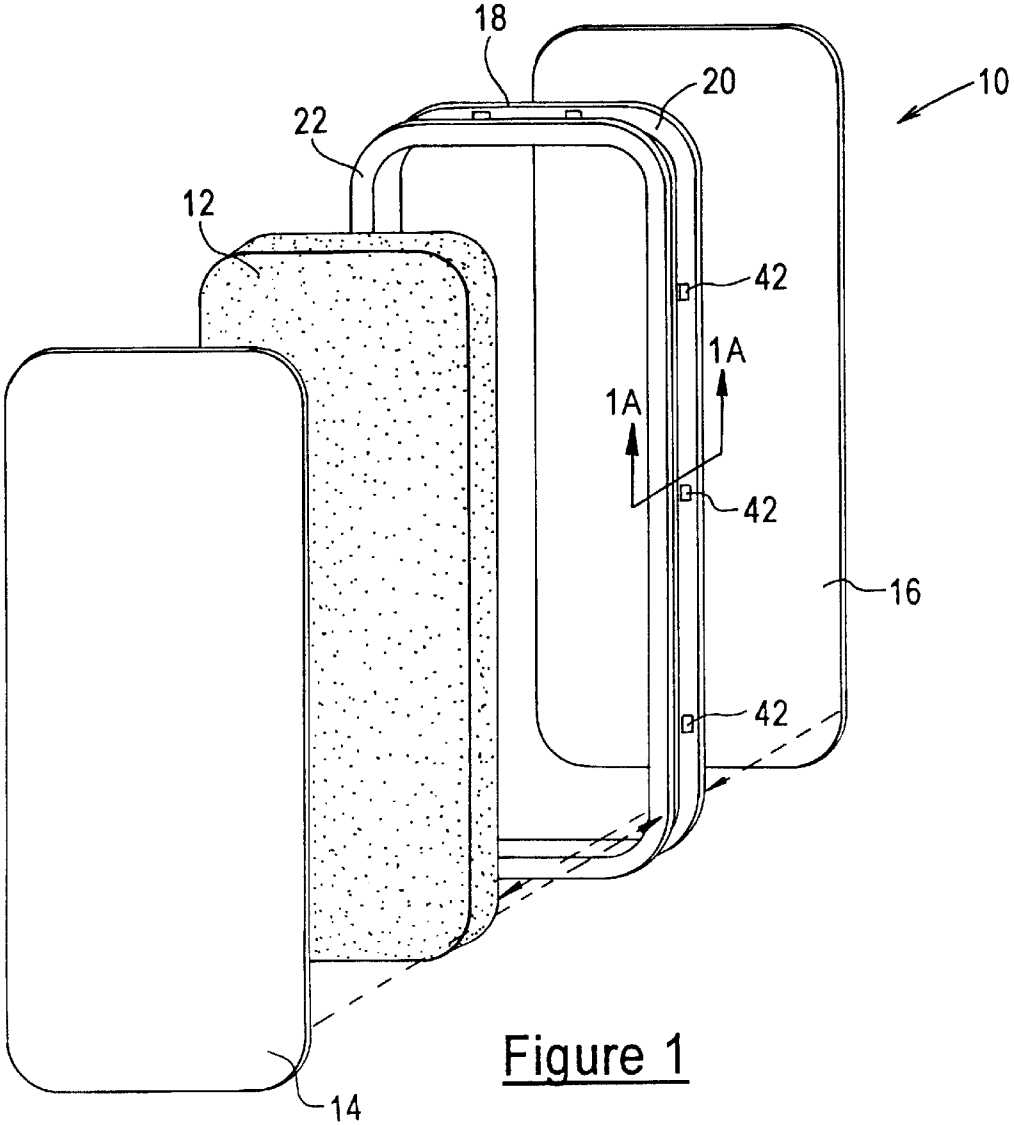
Figure 2:
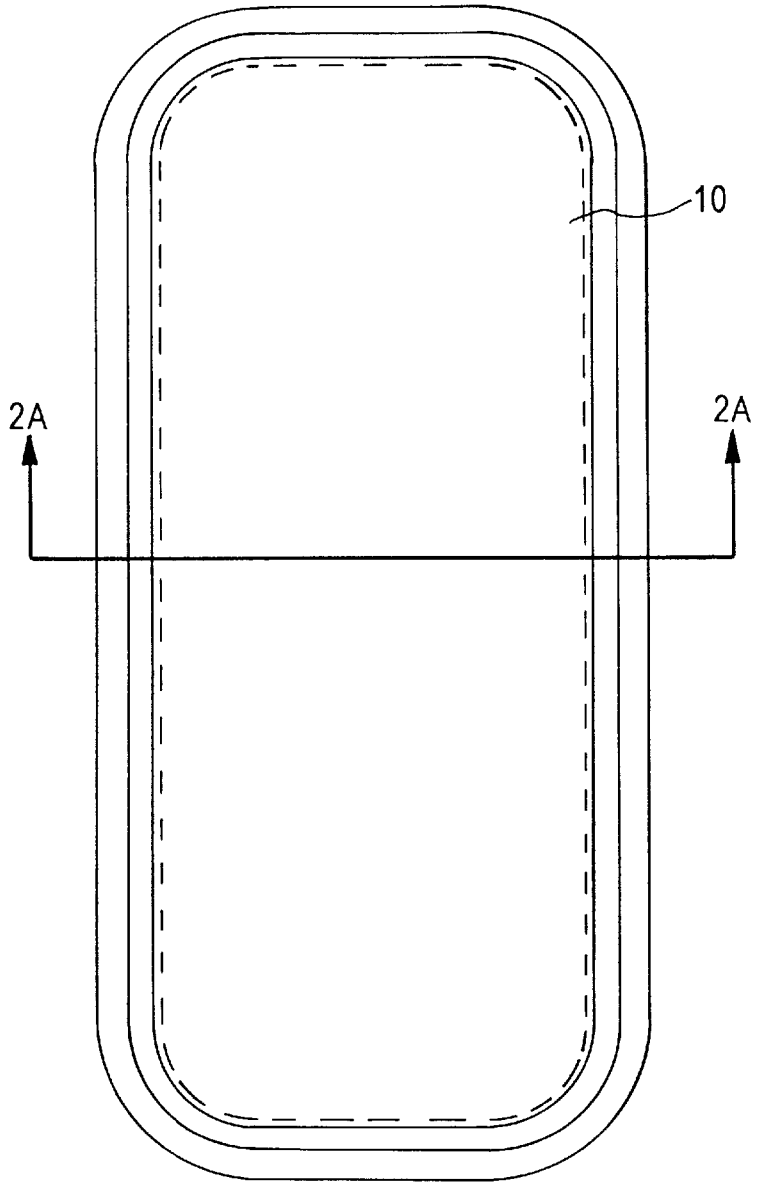
Figure 2A:
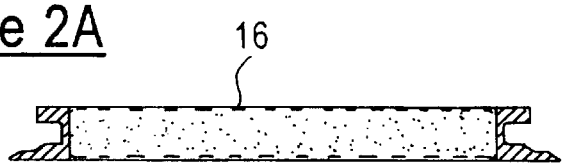
Figure 3A:
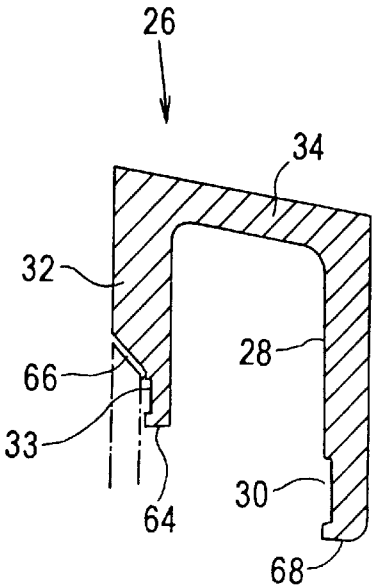
Figure 3C:
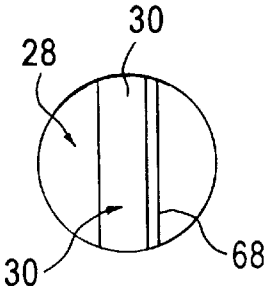
Figure 3B:
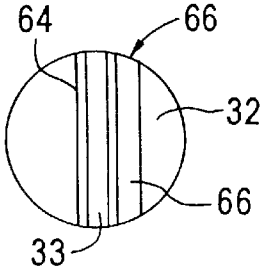
Figure 3:
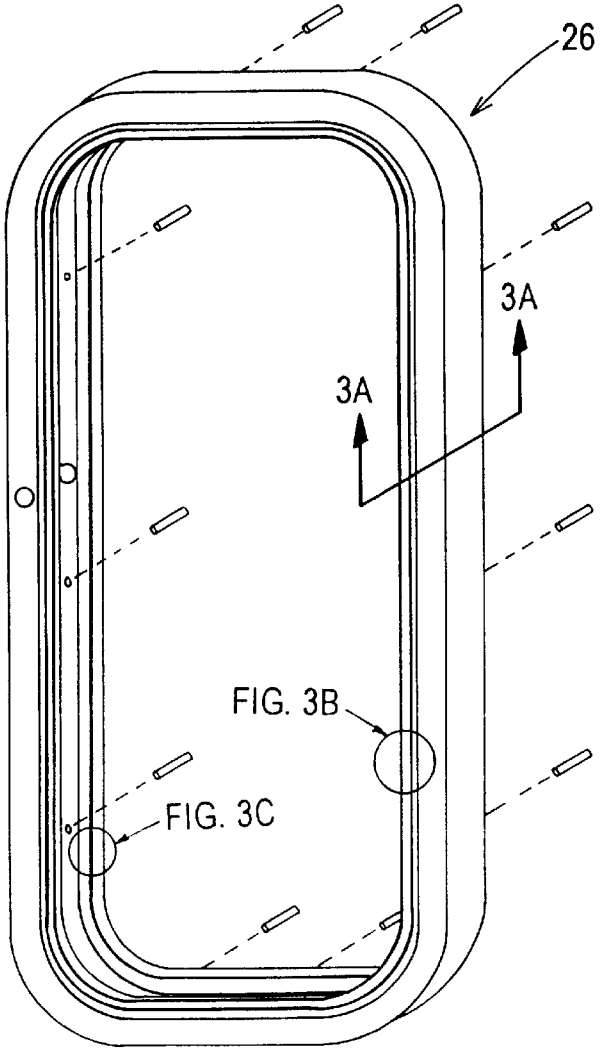
Figure 4:
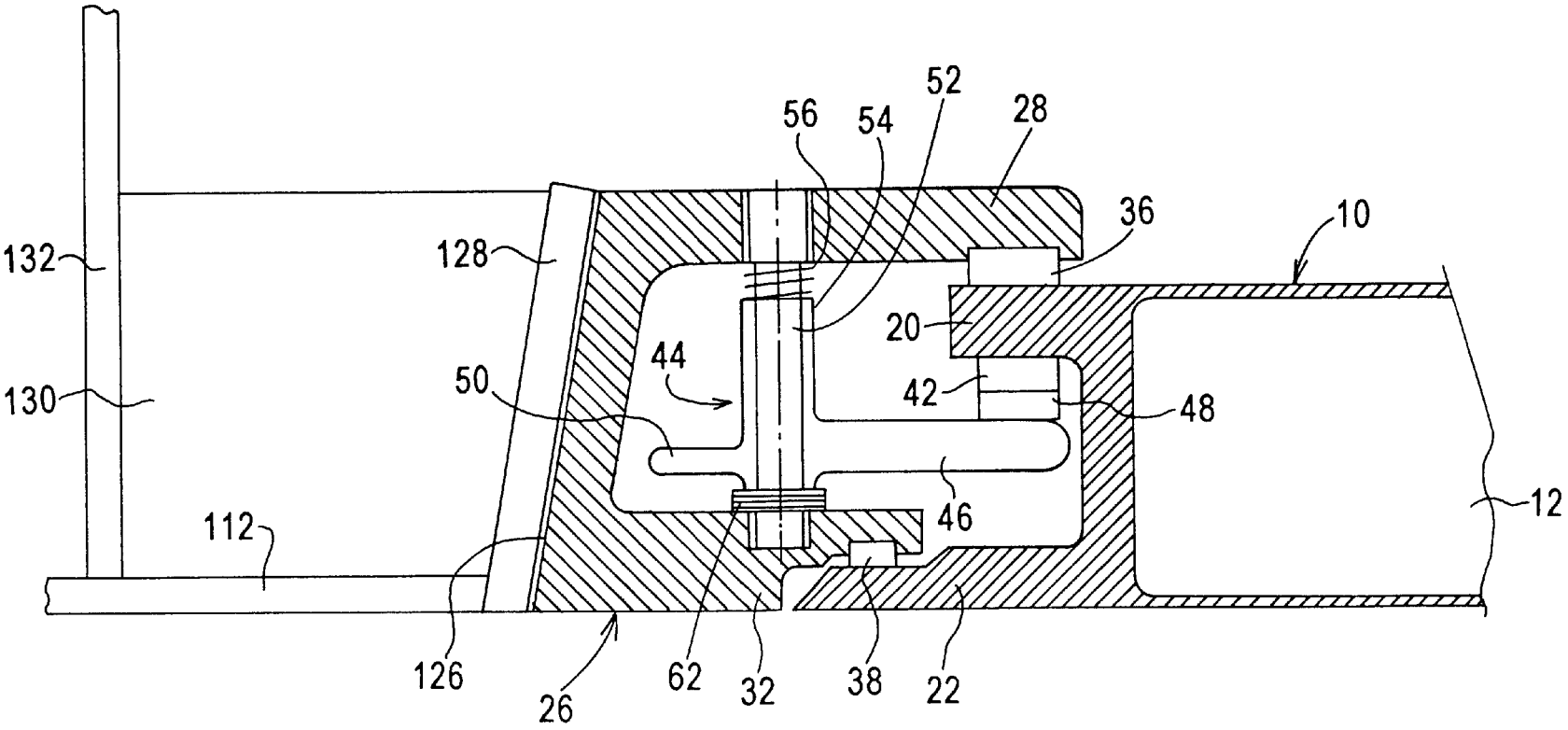
Figure 5A:
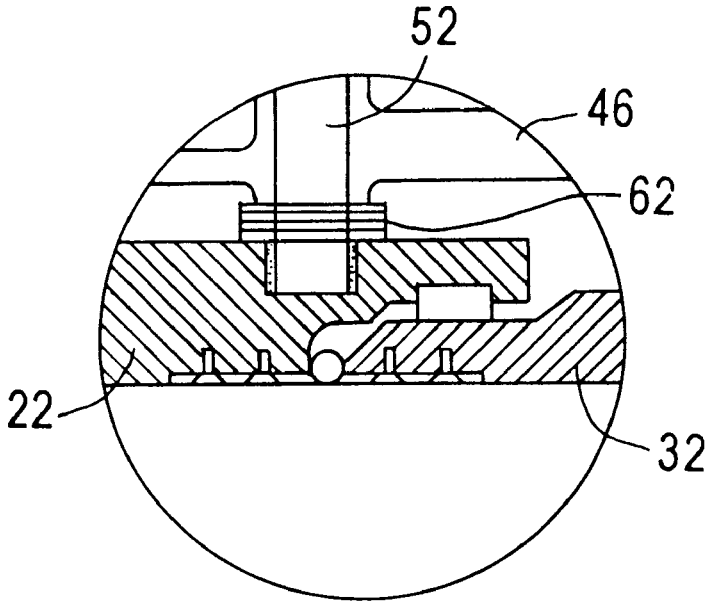
Figure 5B:
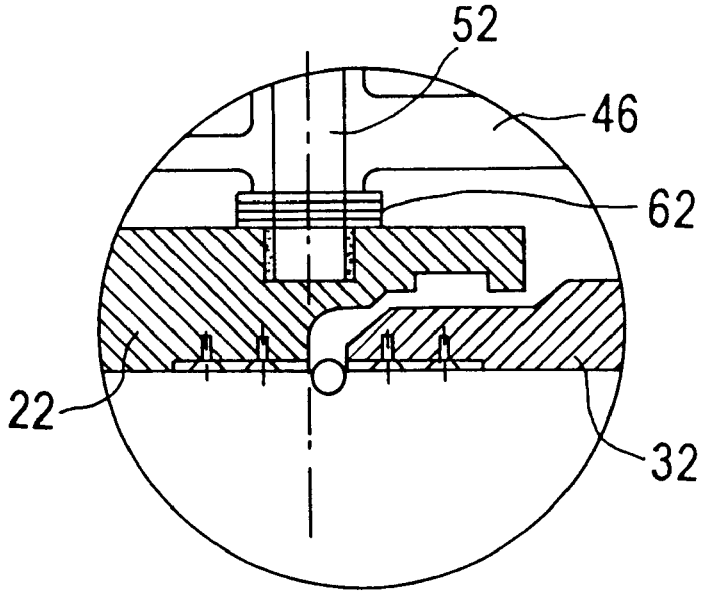
Figure 6:
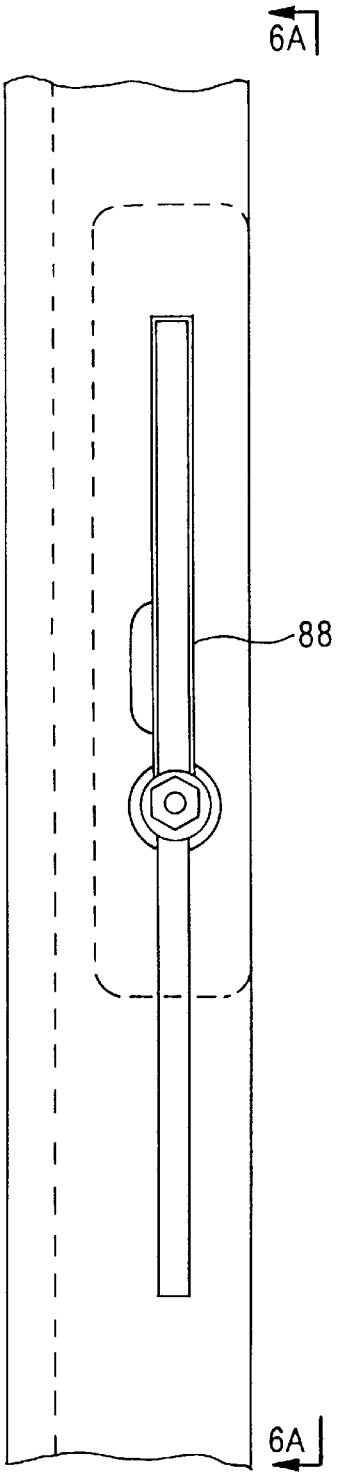
Figure 6A:
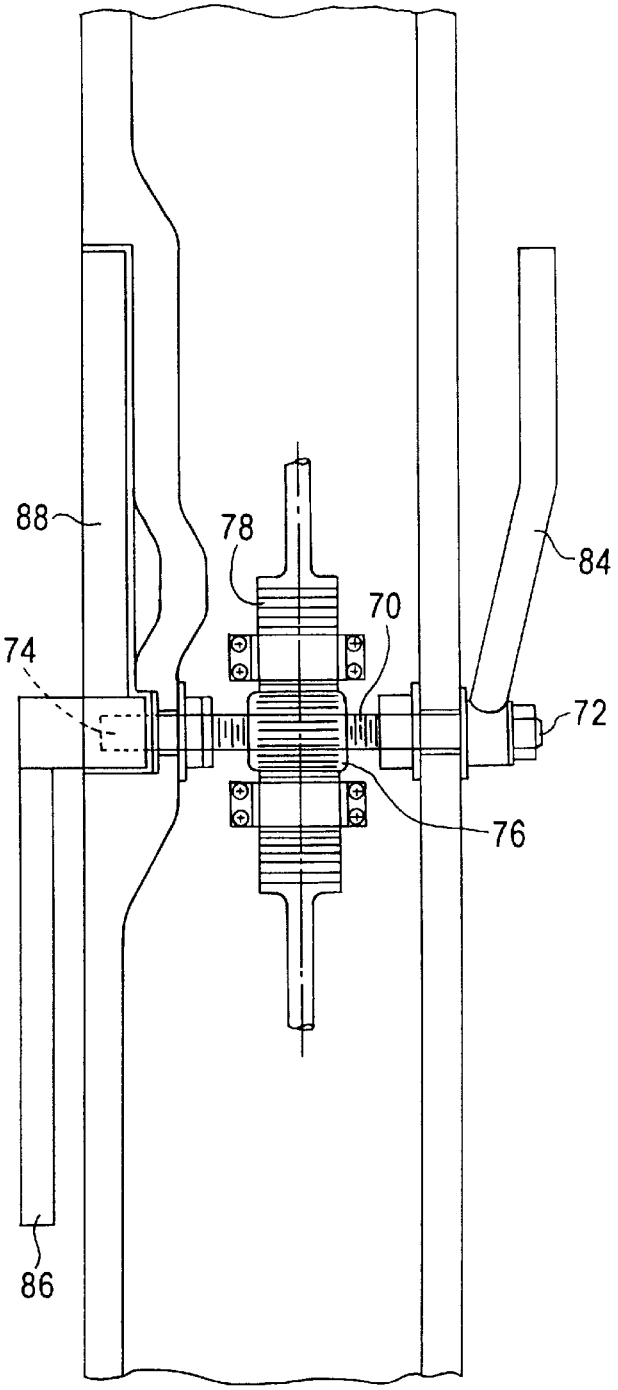
Figure 7B:
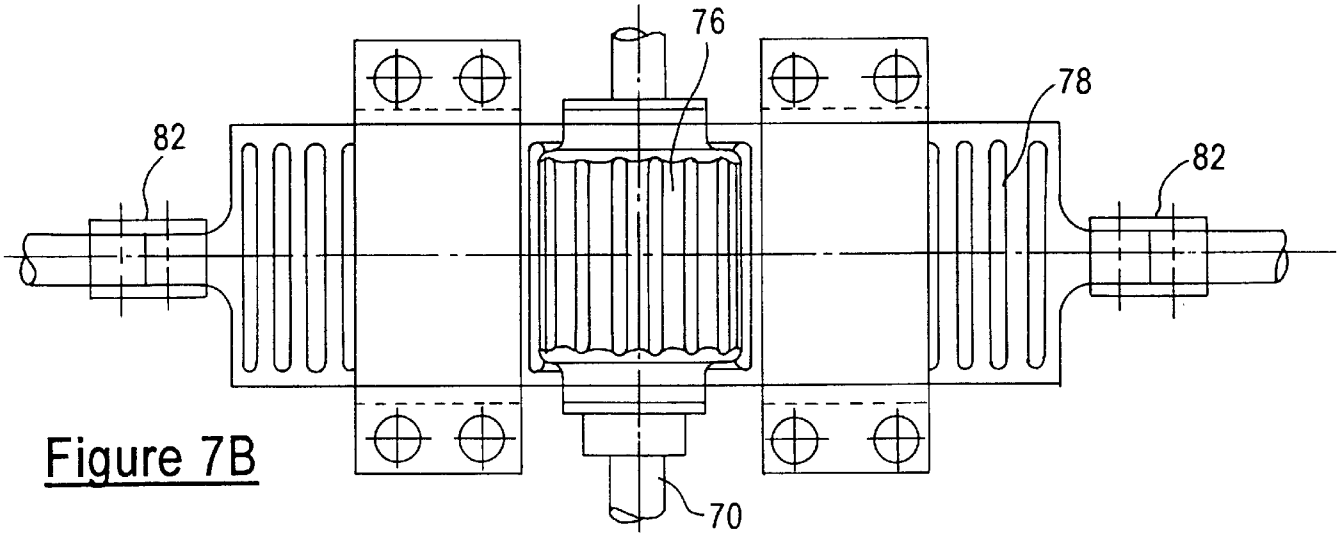
Figure 7A:
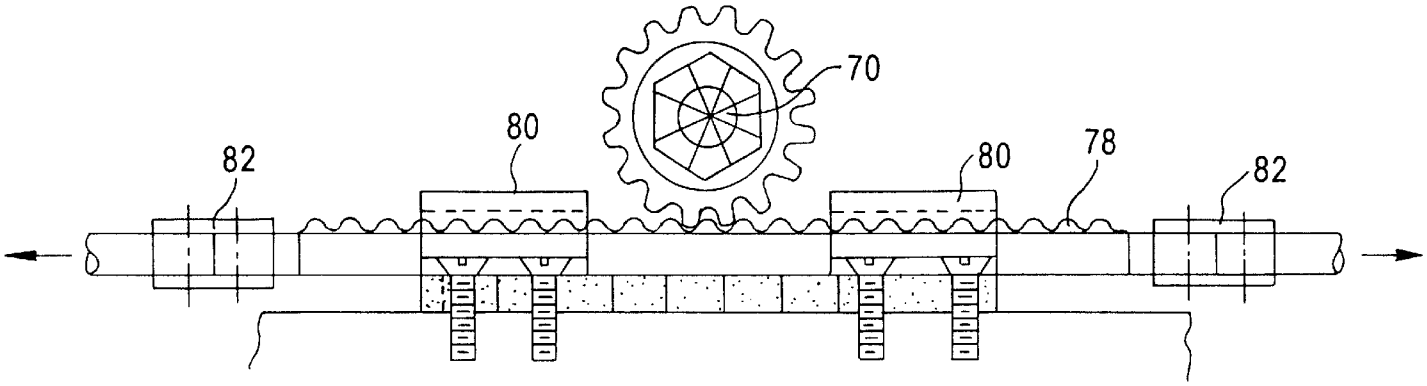
Figure 8:
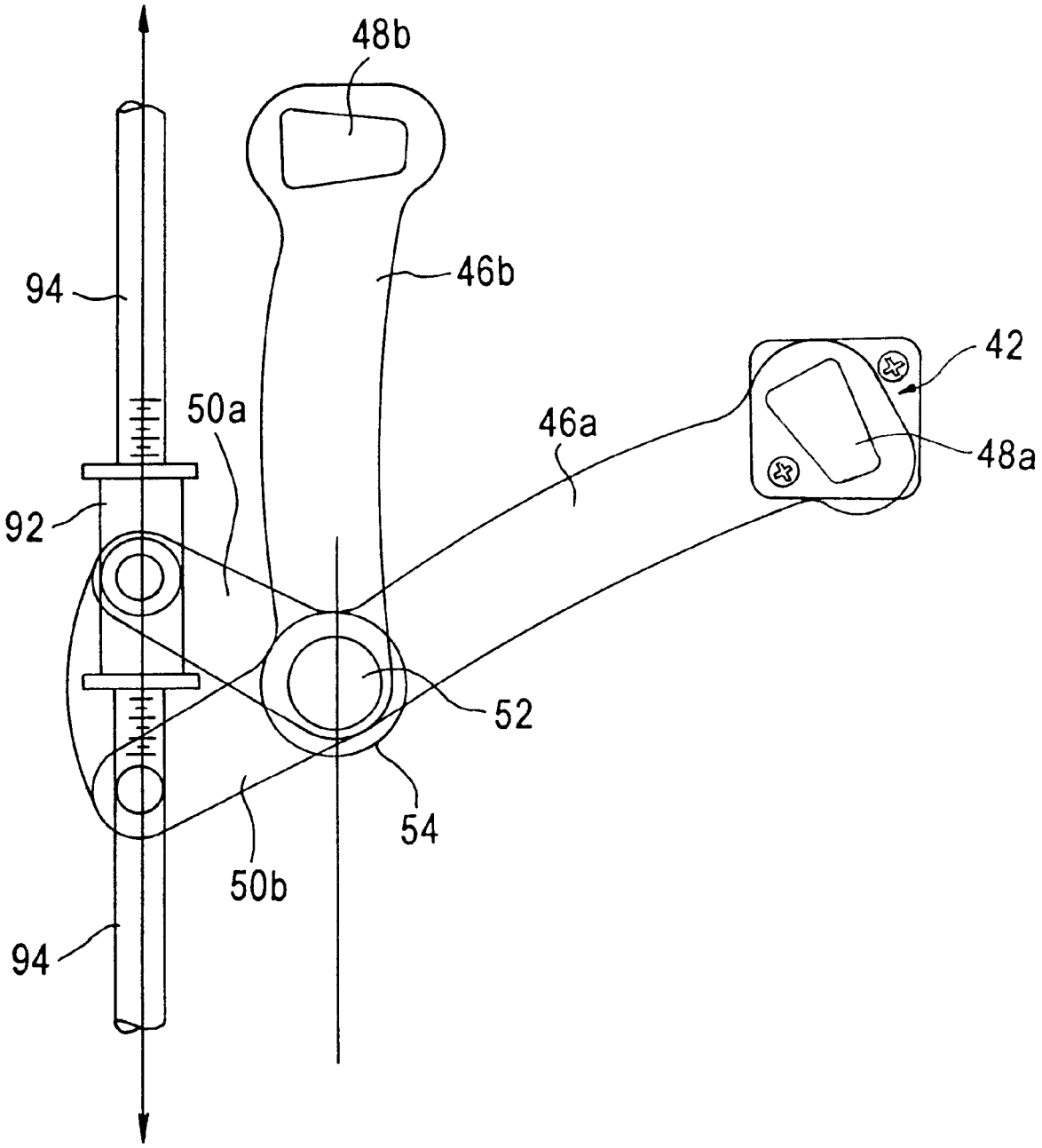
Figure 9:
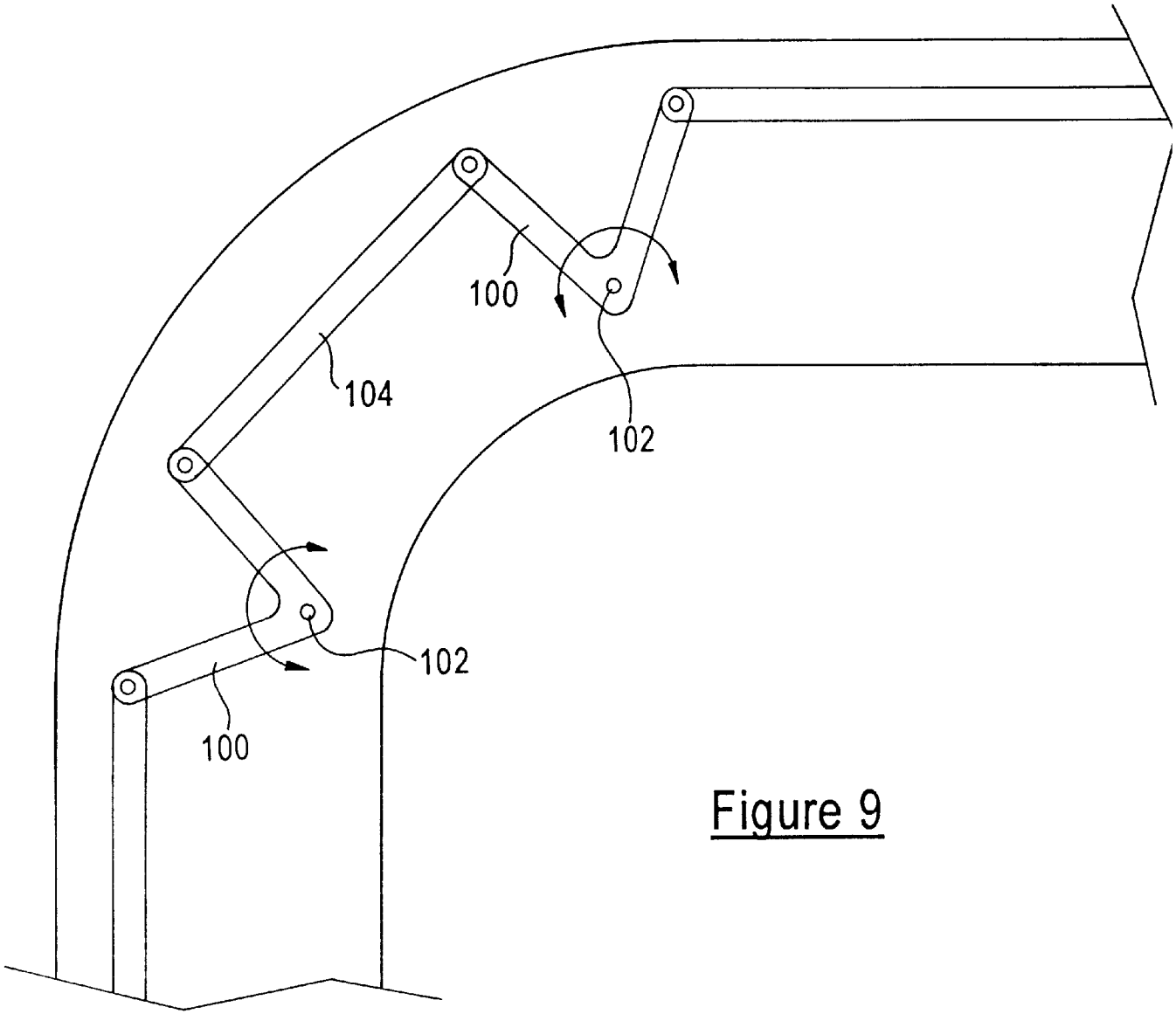
Figure 10:
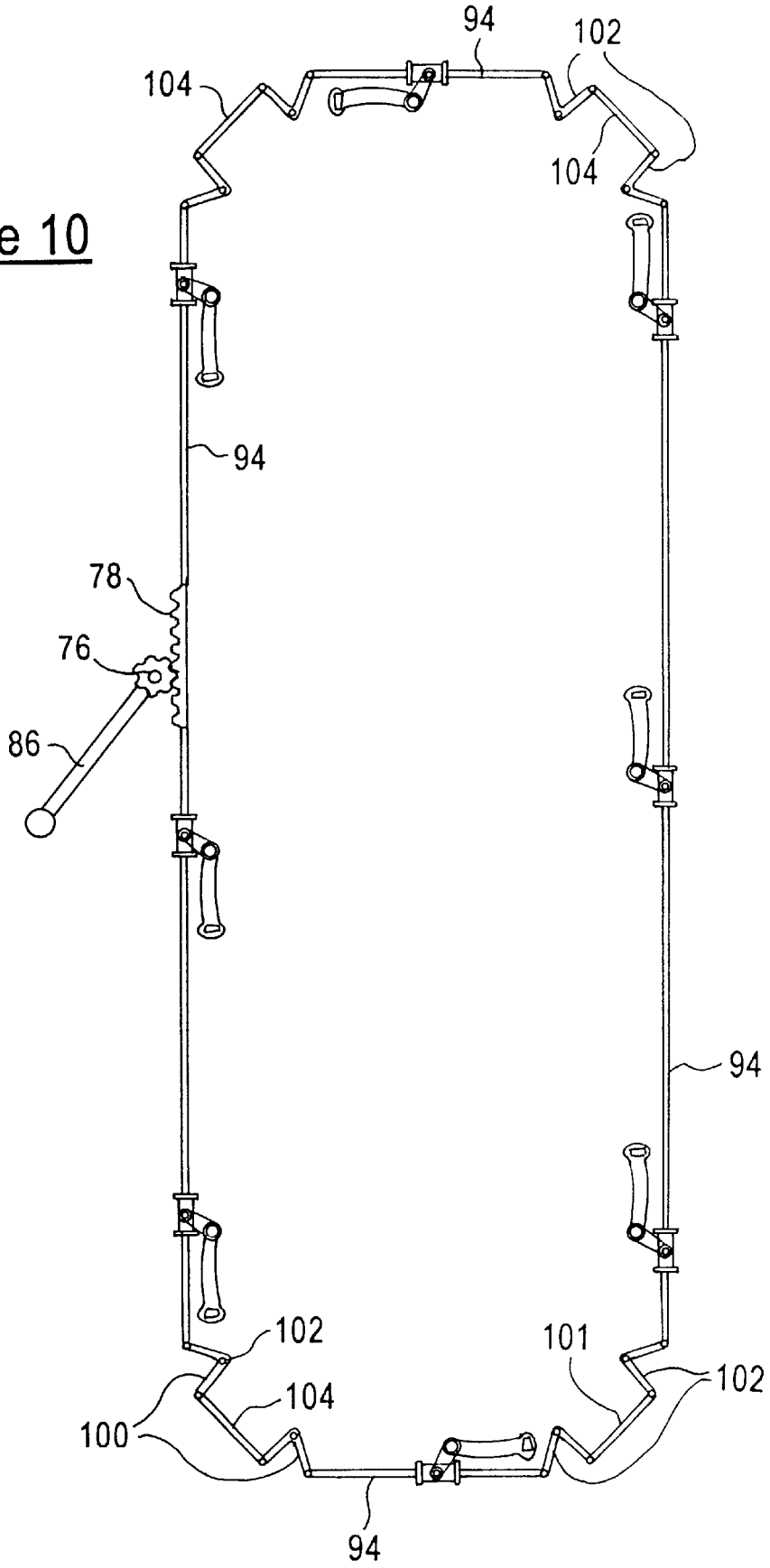
Figure 12:
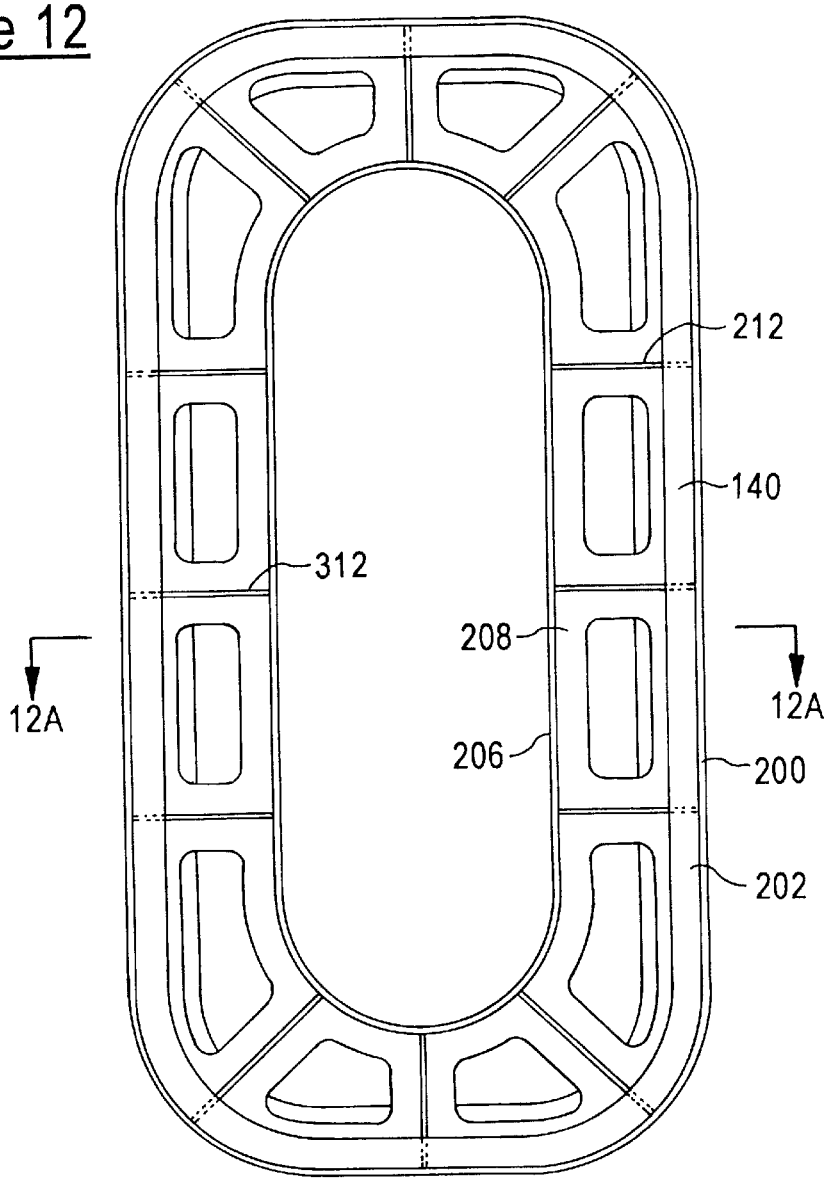
Figure 12A:
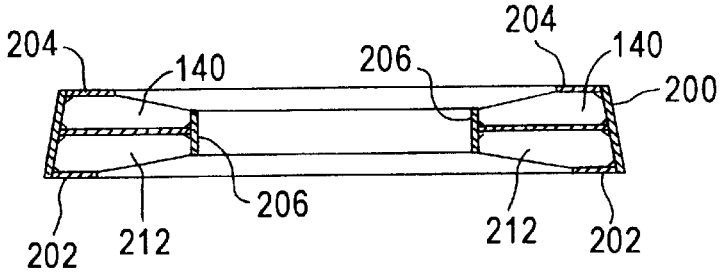
Figure 13:
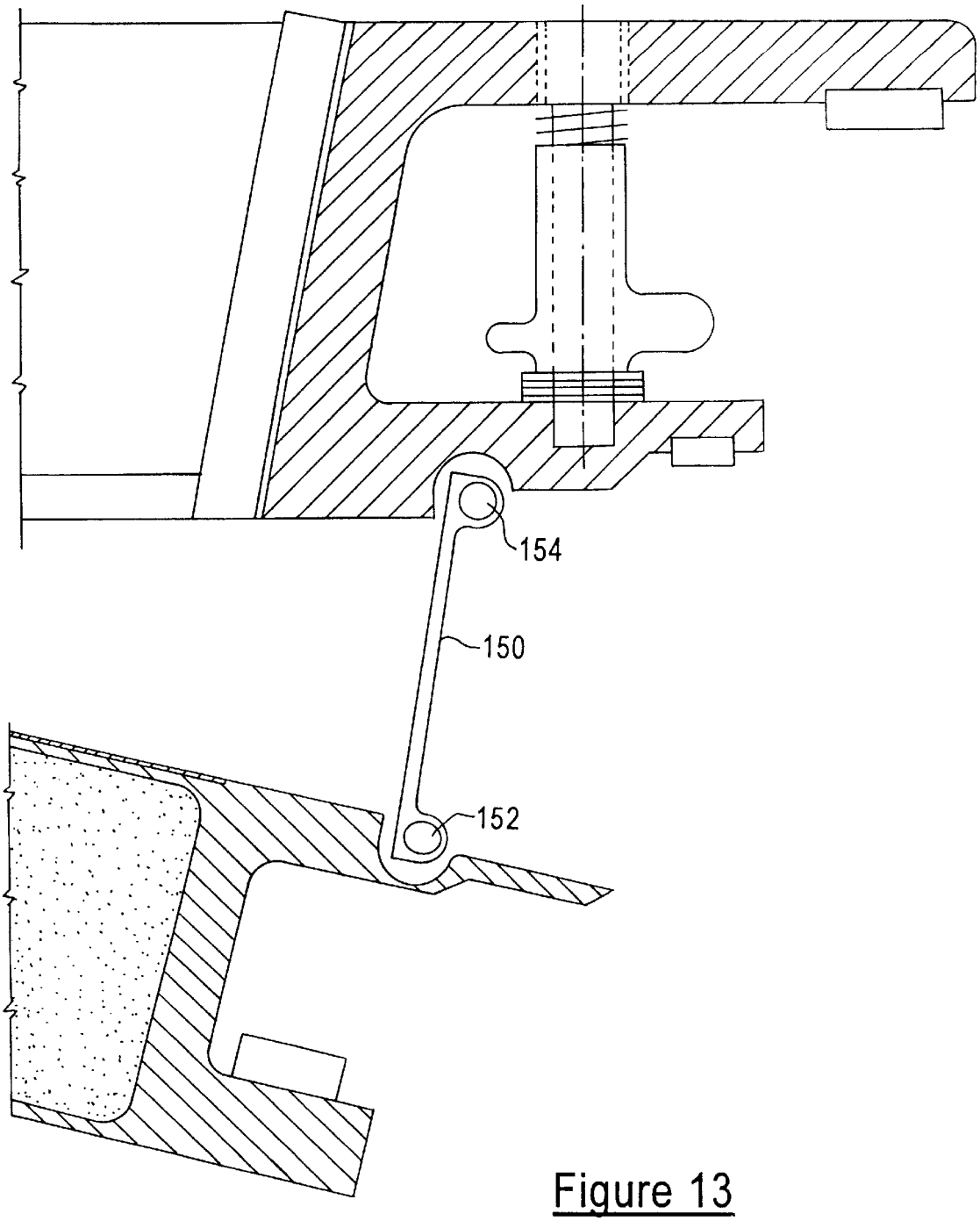
Figure 14:
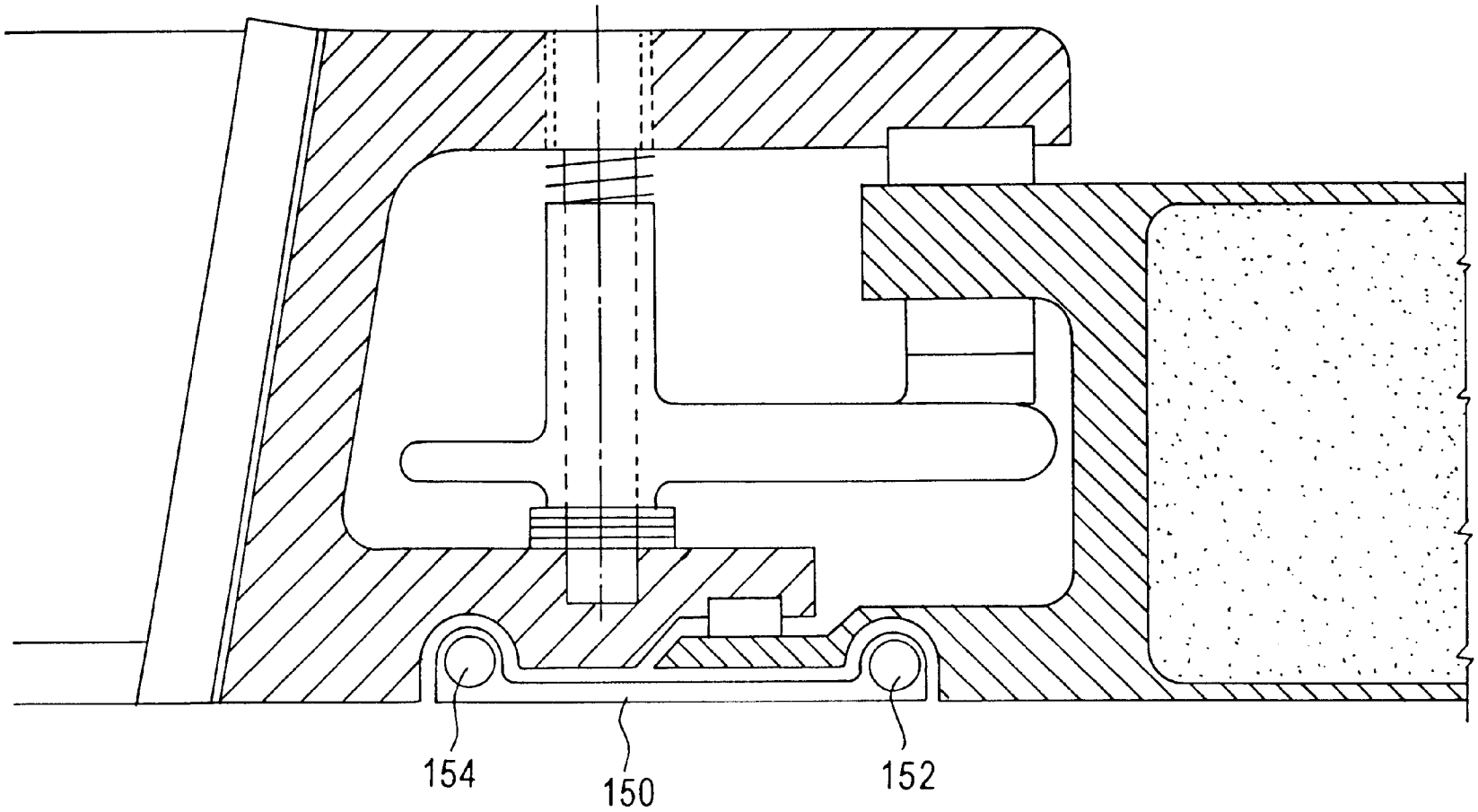
Figure 15:
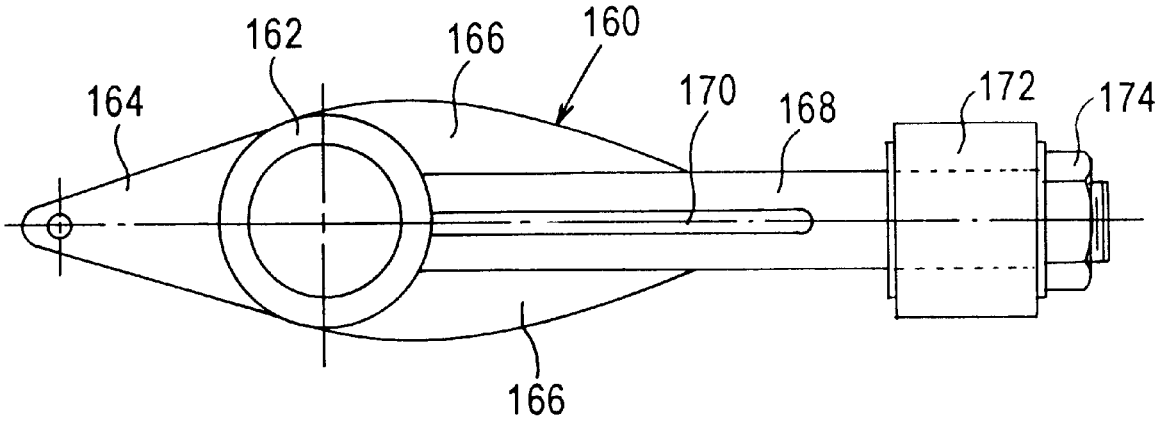
Figure 16:
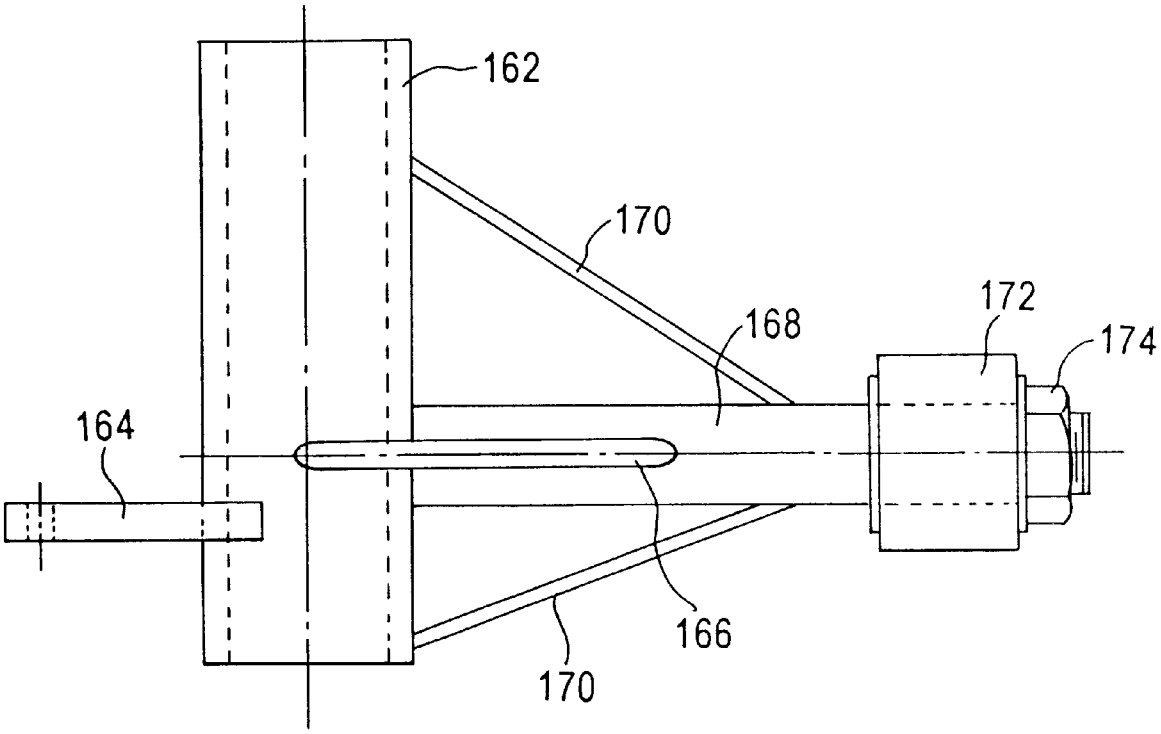
Figure 19:
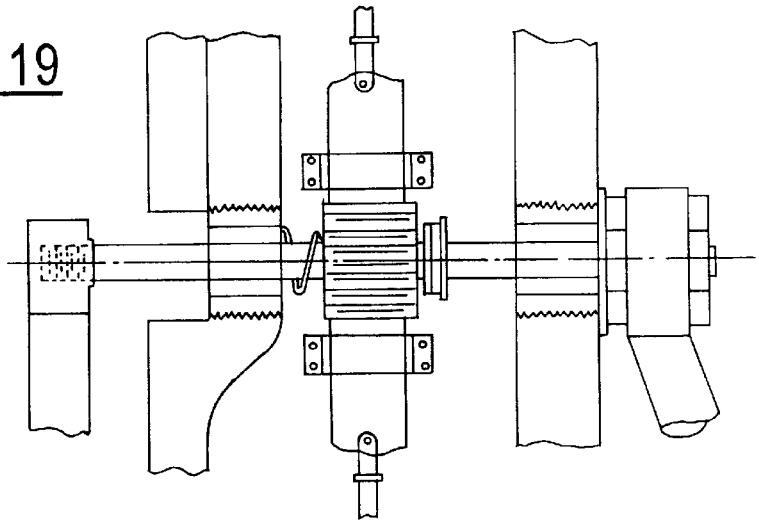
Figure 18:
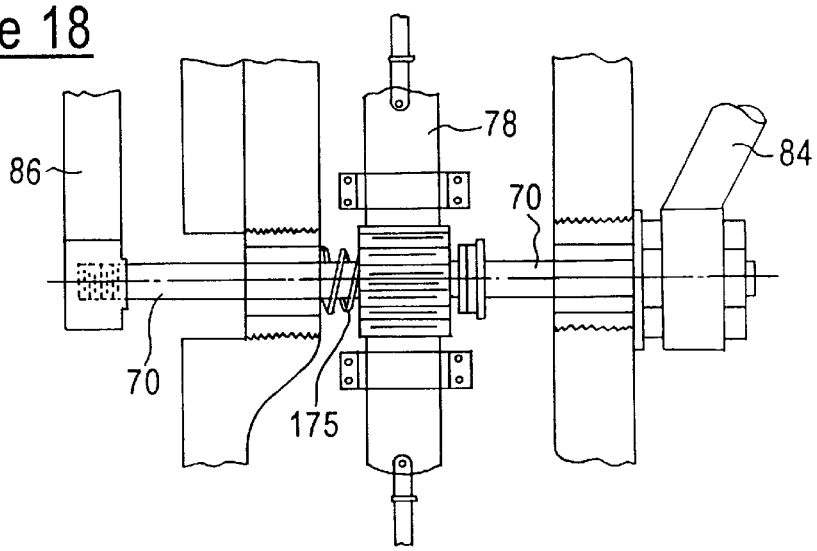
Figure 17:
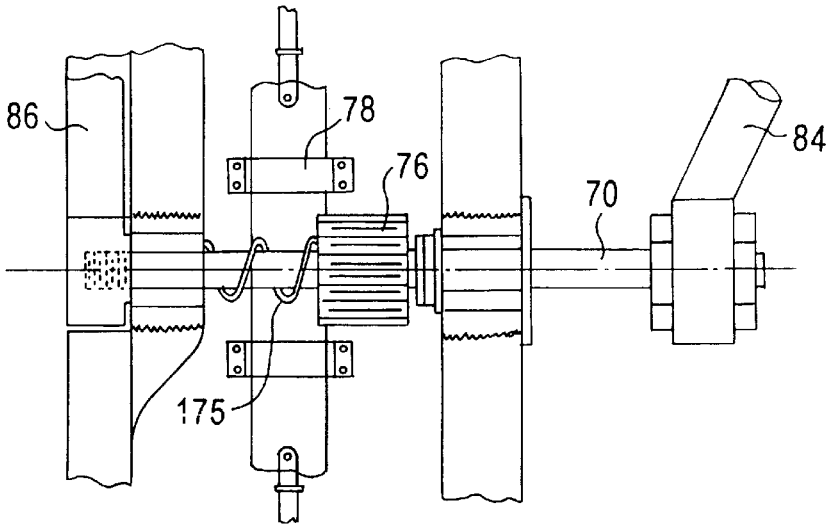

FIG. 1B includes a plan and elevational view of one of a plurality of compression members secured to one of the flanges of a peripheral member which is part of the composite door of FIG. 1;

FIG. 2 is an elevational view of the main door body and the peripheral member forming part of the composite door of FIG. 1;

FIG. 2A is a sectional view taken at the line A—A in FIG. 2;

FIG. 3 is a perspective view of a second peripheral member in the form of a door frame adapted to surround the door body when the latter is in a closed position;

FIG. 3A is a sectional view through the second peripheral member of FIG. 3, taken at the line A—A in FIG. 3;

FIG. 3B is a view of a portion of the peripheral member of FIG. 3 identified by the letter B, and drawn to a larger scale;

FIG. 3C is a view of a portion of the peripheral member of FIG. 3 identified by the letter C, and drawn to a larger scale;

FIG. 4 is a cross-sectional view through both of the peripheral members, showing their relative positions when the door is locked;

FIG. 5A is a partial sectional view of interengaging parts of the two peripheral members utilizing an exterior door hinge design;

FIG. 5B is a partial sectional view of interengaging parts of the two peripheral members utilizing an interior door hinge design;

FIG. 6 is a partial elevational view of the exterior of the peripheral member constituting the door frame, showing open and closed positions of a door handle adapted to close or open the door;

FIG. 6A is an elevational view of the peripheral member constituting the door frame, looking in the direction of the arrows A—A in FIG. 6;

FIG. 7A is an elevational view of a rack and pinion assembly forming part of the lock and release mechanism for the door;

FIG. 7B is a plan view of the rack and pinion assembly of FIG. 7A;

FIG. 8 is a detail plan view of a latch dog and the associated linkage;

FIG. 9 is an elevational view showing a portion of the linkage used for actuating the plurality of latches adapted to hold and/or release the door;

FIG. 10 is a view of the actuating assembly for the entire door, illustrating only those components which are part of the actuating assembly;

FIGS. 11A, 11B, 11C and 11D are schematic sectional views showing various options for securing the door frame to the bulkhead;

FIG. 12 is an elevational view of a coaming jig;

FIG. 12A is a sectional view taken at the line A—A in FIG. 12;

FIG. 13 is a partial sectional view through the door and the door frame, with the door in the open position, showing the operation of a double-ended hinge;

FIG. 14 is a view similar to FIG. 13, but with the door in the closed position;

FIG. 15 is a plan view looking axially at a modified version of the latch used to secure the door in place;

FIG. 16 is an elevational view of the latch seen in FIG. 15;

FIGS. 17, 18 and 19 are sequential sectional views through part of the door frame, illustrating the steps in latching and unlatching the door with respect to door frame;

FIG. 20 is a plan view of a steel hinge for possible use with this invention; and FIG. 21 is a sectional view taken at the line 21—21 in FIG. 20.

DETAILED DESCRIPTION OF THE DRAWINGS

Attention is first directed to FIG. 1, FIG. 1A, FIG. 2 and FIG. 2A, in which a door shown generally at 10 is seen to include a foam core 12 sandwiched between two skin layers which include an exterior skin 14 and an interior skin 16. As used here in reference to the two skins, the words "exterior" and "interior" are relative to the space partitioned off by a wall through which the door opens.

The door 10 incorporates a first peripheral member 18 which is of substantially constant section and which extends around the perimeter of the door.

The first peripheral member 18, having the section shown in FIG. 1A, defines an interior flange 20 and an exterior flange 22. Both flanges 20 and 22 extend in substantially the same direction from opposed parallel edges of a flat web 24 seen in FIG. 1A.

The over-all door assembly further includes a second peripheral member in the form of a door frame 26, seen in perspective in FIG. 3. The second peripheral member (door frame) 26 is adapted to surround the door body when the latter is in a closed position, the door frame 26 having an inner flange 28 defining a longitudinally extending gasket recess 30, and an outer flange 32 defining a longitudinally extending gasket recess 33, both flanges 28 and 32 extending in substantially parallel relation from a web 34 extending obliquely with respect to the flanges 28 and 32. Thus, both of the flanges 28 and 32 extend generally in parallel toward the main door body 10 when the latter is in the closed position.

Gasket means includes an elongate, closed-loop gasket 36 (see FIG. 4) disposed between the inner flange 28 of the door frame 26 (lodged in the recess 30) and the interior flange 20 of the first peripheral member 18. The gasket means further includes an external gasket 38 lodged in the recess 33 in the outer flange 32 of the second peripheral member 26. The various gaskets, gasket recesses and flanges are so disposed with respect to each other that movement of the main door body 10 in a given direction generally perpendicular to the direction in which the inner and outer flanges extend, causes the gaskets to be compressed. To be more specific, attention is drawn to FIG. 4 from which it can be seen that if the main door body 10 were to be moved upwardly while the door frame 26 were held stationary, the gaskets 36 and 38 would undergo compression.

The interior flange 30 of the main door body 10 supports a plurality of spaced-apart compression members 42, the purpose of which will become evident from what follows.

For each compression member 42, there is provided a latch member seen generally at 44, the latch member having what can be generally regarded as a pressure component 46, in the shape of an elongate arm. The latch member is mounted to the door frame 26 for movement between (1) a first position in which the pressure component 46 presses against its respective compression member 42 in a direction tending to move the main door body 10 in the direction in which the gaskets are compressed, and (2) a second position in which the pressure component 46 does not press against its respective compression member. In the embodiment shown in FIG. 4, the compression members 42 are of uniform thickness, whereas the pressure component 46 carries a wedge-shaped portion 48. FIG. 4 thus shows what has been defined above as the "first position" for the latch member.

There is further provided a linkage assembly interconnecting all latch members 44 and adapted to move the latch members in tandem between their respective first and second positions. The linkage assembly is operatively connected to the latch member 44 by means of a linkage arm 50.

Referring again to FIG. 4, each latch member includes: a latch pin 52 mounted to the door frame and extending between and substantially perpendicularly with respect to the flanges of the door frame, a rotary member 54 mounted on the latch pin 52 for axial movement therealong and for rotation thereabout, the pressure component 46 described previously, which is fixed to and extends radially away from the rotary member 54, and the pressure component 48 which in this embodiment is wedge-shaped.

The latch member further includes a resilient compression coil spring 56 which surrounds the pin 52 between the rotary member 54 and the inner flange 28 of the door frame, thus urging the rotary member 54 to slide along the latch pin 52 in the direction which would relieve the compression of the gaskets. Finally, the latch member includes spacer means in the form of washer-spacers 62.

The linkage assembly functions by pulling or pushing the linkage arm 50 of all latch members in tandem, causing rotation of the rotary member 54 about the latch pin 62 thus causing engagement and disengagement between the wedge-shaped portions 48 and the corresponding compression members 42.

The arrangement of the various flanges, gaskets and latch member components illustrated in FIG. 4 represents a satisfactory configuration. However, it should be recognized that it is conceivable to mount the latch member on the door itself (specifically between the two flanges), while positioning the compression member (42) on the door frame.

In other words, having the latch pin mounted to the door frame and pressing upwardly against a flange of the door periphery to compress the gasket 36, would be functionally equivalent to mounting the same latch member to the door itself, in a reversed orientation, in such a way that it pushed downwardly ("up" and "down" being in accordance with FIG. 4) against one of the flanges of the door frame 26. This would again push upwardly on the door periphery, thus compressing the gasket 36.

It will be understood that the function of the spacers 62 is to determine the maximum compression of the gaskets 36 and 38, since the final position of the pressure component 46 with respect to the door frame 26 will be determined by the number and thickness of the spacers 62.

In FIG. 3B the free edge of the outer flange 32 is shown at 64. FIG. 3B also illustrates a sloping or oblique face 66, the purpose of which is to permit the corresponding exterior flange 32 of the door to lie flush with the adjoining part of the door frame.

FIG. 3C likewise shows the edge 68 of the inner flange 28 along with the gasket recess 30.

It will be noted that the specific configuration or profile of the exterior flange 32 of the door frame 26 differs slightly between the variants shown in FIG. 3A and that shown in FIG. 4. Both of these configurations, however, achieve a flush fit between the flanges 22 and 32.

FIGS. 5A and 5B illustrate the provision of door hinges. In FIG. 5A the hinge on the exterior, whereas in 5B the hinge is in the interior.

Attention is now directed to FIG. 6, FIG. 6A, FIG. 7A and FIG. 7B, illustrating the major operating means for the linkage assembly which moves the latch members in tandem. A shaft 70 is mounted on the door frame for rotation about its axis, and for longitudinal sliding movement. The shaft 70 has an inner end 72 and an outer end 74. The shaft 70 is fixedly secured to a pinion gear 76 which meshes with a slidable rack 78 which is a component of the linkage assembly.

Thus, the pinion 76 undergoes axial and rotary movement along with the rod 70.

Illustrated in FIGS. 6A, 7A and 7B are rack retainers 80 of conventional construction. The rack 78 is connected at both ends, via linkage couplers 82 (FIGS. 7A and 7B), to a series of links which will be described below.

The inner end 72 of the shaft 70 has an inner handle 84 connected thereto while the outer end 74 is connected to an external door handle 86.

A handle recess 88 is provided for receiving the external handle 86 when the external handle 86 is aligned therewith. In FIGS. 6 and 6A, the external handle 86 is shown in the "open" position extending downward from the location of the shaft 70. By rotating the shaft 70 through 180° (utilizing either handle), the external door handle 86 will arrive at a position in which it can be withdrawn into the recess 88 by pulling rightwardly on the shaft 72, utilizing the internal handle 84, or simply by pressing the external door handle 86 into the recess 88 from the outside.

FIG. 8 shows a plan view of one of the latch members, seen in two different rotational positions. In a first position, the pressure component 46*b* is directed longitudinally with respect to the peripheral member of the door frame, while the linkage arm 50*b* extends from the rotary member 54 at an angle of approximately 120° with respect to the pressure component (arm) 46*b*. The latch member is adapted to pivot about the axis of the latch pin 52 to a position identified in FIG. 8 by a pressure component 46*a* and a linkage arm 50*a*. As can be seen, the wedge-shaped portion identified as 48*a* in FIG. 8 when the pressure component 46*a* is at the appropriate position. This causes the wedge-shaped portion 48*a* to interfere with the compression member 42 (shown in isolation in FIG. 8, but understood to be secured to the interior flange 20 of the main door body).

As noted in FIG. 8, the linkage arm 50 is pivotally connected, remote from the pin 52, to an attachment member 92 into which rods 94, forming part of a linkage assembly are threaded.

FIG. 9 is a partial elevational view of a corner of the door frame 26, drawn to a larger scale and illustrating the actuating assembly incorporating a plurality of bell cranks 100 (only two visible in FIG. 9, with all visible in FIG. 10). The bell cranks are pivoted to the door frame at pivot points 102. By comparing FIGS. 9 and 10 it will be clearly evident how rotation of the handle 84 (or handle 86) causes the pinion 76 to interact with the rack 78 which in turn moves a plurality of substantially straight rods 94 extending along the main edges of the door frame, and also a plurality of transitional rods 104 located at the corners of the door frame.

In FIG. 10, the linkage assembly is in the condition corresponding with the door being unlatched. By lifting on the handle 86, the pinion 76 rotates while it engages the rack, thus simultaneously moving all of the rods 94 and 104.

Figure 11B:
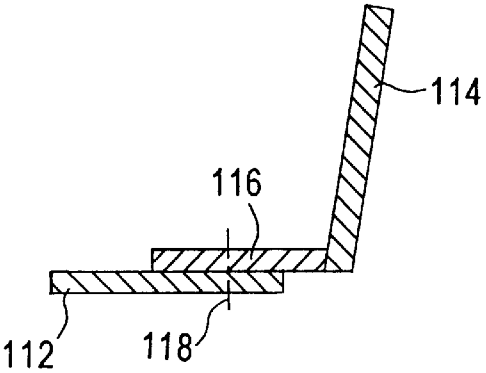
Figure 1D:
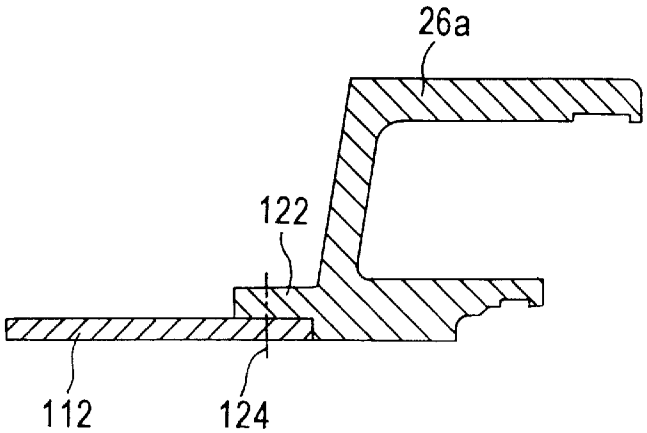
Figure 11A:
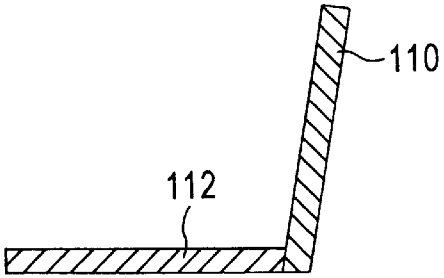

FIGS. 11A, B, C, and D are schematic sectional views through four possible configurations of the coaming which receives the composite door frame. In FIG. 11A, the coaming is disposed obliquely with respect to an existing structure 112 (typically forming part of the wall through which the door will open).

FIG. 11B shows an oblique coaming member 114 welded to a flange plate 116, with the plate 116 being bolted along the line 118 to the existing structure 112.

Figure 11C:
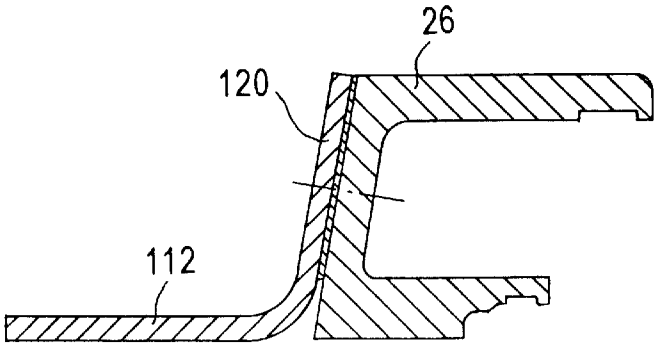

FIG. 11C shows a section through the composite door frame 26 which is secured to an oblique marginal portion 120 which is bent through an obtuse angle with respect to the existing structure 112.

Finally, FIG. 11D shows a modified door frame 26A having a flange 122 which is bolted to the existing structure 112 by a bolt or other fastener extending along the axis identified as 124.

As a variant of the configuration shown in FIG. 11C, attention is directed again to FIG. 4 which illustrates a door frame gasket 126 lying between the door frame 26 and a portion of steel coaming 128.

The purpose of the coaming (110, 114, 120 and 128) is to prevent warping or buckling of the bulkhead, thus helping to preserve the water-tight integrity of the door. Preferably, the coaming is made of the same material as the bulkhead to which the door frame is attached, and the thickness of the coaming is slightly greater than that of the bulkhead. The coaming would be mounted to the bulkhead in a manner consistent with the material being utilized (e.g. a welded construction for steel or aluminum bulkheads, and a bolted construction for composite bulkheads). The coaming is canted inwardly about 10 degrees from a perpendicular taken to the plane of the door. In addition to increasing protection against racking or buckling, the 10-degree angle also serves as a self-centering mechanism for the door frame when installed into the bulkhead opening. The coaming also includes a number of chocks 130 (see FIG. 4) connecting the coaming with the adjacent ship structure 132 (see FIG. 4). Preferably, the chocks 130 are mounted perpendicular to both the coaming and the existing structure. In the case of a thin bulkhead, the door frame may be bolted directly to the bulkhead as seen in FIG. 11D. Instead of using a coaming, either the door frame or the bulkhead could be flanged. The door described above and illustrated in the accompanying drawings has an improved radar cross-section (RCS). Also contributing to the improved RCS properties is the provision of the short flange (interior flange) of the peripheral member enclosing the main door body, since this allows the door to be recessed.

FIGS. 12 and 12A show, respectively, an elevational view and a sectional view (at the line A—A) of a jig fixture useful in installing, with a minimum of warping, the door assembly set forth in this specification. The jig fixture includes a sloping outer wall 200, a first flange 202 extending inward from one edge of the outer wall 200, a second flange 204 extending inward from the other edge of the outer wall 200 and parallel with the first flange 202, an inner band 206 spaced inwardly from the outer wall 200, and a web 208 extending from the middle of the outer wall 200 to the middle of the inner band 206, the web having a plurality of openings 210. Also provided are a plurality of partitions 212 spaced at regular intervals around the jig fixture and extending perpendicular with respect to a plane containing any of the other components.

The outer ring of the fixture will be roughly fit to the inner diameter of the coaming. The coaming is placed in the jig fixture and installed in accordance with the procedure described herein. Under normal circumstances, welding the coaming in place would cause significant warpage of the thin steel. The jig fixture ensures that warping will not extend to the interior of the coaming. This is important since warping to the interior might prevent installation of the door and frame.

Attention is now directed to FIGS. 20 and 21, which illustrate a possible configuration for a stainless steel hinge 179 of rectangular configuration, having four upstanding pivot bosses 182 at the respective corners of the rectangular configuration, each boss 182 having a centrally bored aperture and containing an aluminum bronze sleeve. Standard hinge pins would be utilized with the hinge shown in FIGS. 20 and 21, in order to hingedly secure the door to the door frame.

More particularly, to install the door coaming the following steps are taken:

(a) Firstly, the bulkhead penetration is laid out, checked and cut.

(b) The jig 140 shown in FIG. 12 is installed into the steel coaming and placed into the bulkhead penetration.

(c) The coaming is then tack-welded to the bulkhead all around the opening.

(d) The coaming-to-bulkhead brackets are tack-welded into place.

(e) With the jig in place, the coaming-to-bulkhead brackets are welded completely, but only a little at a time to avoid putting too much heat into the joint and causing warpage.

(f) With the jig 140 in place, the coaming-to-bulkhead joint is welded completely, but only a little at the time to avoid putting too much heat into the joint, thus causing warpage.

(g) The jig 140 is then removed and the coaming dimensions are checked.

(h) If necessary, modifications to the structure are performed, to ensure that the bulkhead is in the correct plane and the coaming is straight.

In order to install the door frame, the following steps are taken:

(a) Firstly, the coaming gasket 126 (see FIG. 4) is placed in the door coaming.

(b) The door frame is placed into position and a correct fit is ensured before clamping the door frame to the coaming.

(c) The coaming is marked through holes in the door frame.

(d) The door frame is then removed.

(e) Holes are drilled for the door frame installation.

(f) The door frame is placed into the coaming and installed utilizing bolts tightened to the appropriate torque readings.

FIGS. 13 and 14 illustrate an open position and a closed position, respectively, of a composite door with respect to the door frame, utilizing a linkage-hinge 150 having two hinge axes 152 and 154 at opposed, parallel, spaced-apart edges.

FIGS. 15 and 16 illustrate a modified embodiment of the latch member 160, having a cylindrical rotary member 162, a linkage arm 164, strengthening flanges 166, a pressure arm 168, and oblique braces 170 extending between the rotary member 162 and a distal portion of the pressure arm 168. The pressure arm 168, in the embodiment illustrated, supports a freely rotating roller 172, which is mounted on a flanged, self-lubricating bushing (not visible in the drawings) and is held in place by conventional structure of standard construction, which may include a nut 174.

FIGS. 17, 18 and 19 illustrate three different positions for the actuating and locking mechanism. In FIG. 17, the door is closed and latched. The rod 70 is pulled fully to the right, causing the handle 84 to be displaced rightwardly from the door frame, and causing the outer handle 88 to be recessed into the external part of the door frame, as described earlier in connection with FIGS. 6 and 6A. It is to be noted that the pinion 76 remains in an engagement with the rack 78. It will also be noted that a compression coil spring 175 has the effect of urging the pinion 76, rod 70 and both handles 84 and 86 toward the right.

FIG. 18 shows the position of the rod 70 after having been pushed fully to the left. The handle 84 is now adjacent the door frame, and the handle 86 has been pushed out of the recess in which it was contained in FIG. 17. The pinion 76 is now at its maximum engagement with the rack 78.

FIG. 19 shows the same portion of the structure after the handles 84 and 86 have been rotated through 180°, thus shifting the rack 78 and actuating the linkage structure.

While several embodiments of this invention have been illustrated in the accompanying drawings and described hereinabove, it will be evident to those skilled in the art that changes and modifications may be made without departing from the essence of this invention, as set forth in the appended claims.

We claim:

1. A door assembly comprising:

a. a main door body, b. a first peripheral member of substantially constant section extending around the perimeter of said main door body, said first peripheral member defining interior and exterior flanges, both flanges extending generally away from the main door body, c. a second peripheral member in the form of a door frame adapted to surround the door body when the latter is in a closed position, the door frame having an inner flange and an outer flange, both of which extend generally toward the main door body when the latter is in said closed position, d. gasket means between a flange of said first peripheral member and a flange of said second peripheral member, such that movement of the main door body in a given direction generally perpendicular to the direction in which the inner and outer flanges extend causes compression of the gasket means, e. a plurality of spaced-apart compression members secured to one of the flanges of one peripheral member, f. for each compression member, a latch member having a pressure component, the latch member being mounted on the other peripheral member for movement between 1) a first position in which the pressure component presses against its respective compression member in a direction tending to move the main door body in said given direction, thus compressing the gasket means, and 2) a second position in which the pressure component does not press against its respective compression member, and g. a linkage assembly operably interconnecting all latch members and adapted to move the latch members in tandem between their respective first and second positions, the linkage assembly including operating means for operating the linkage assembly.

2. The door assembly claimed in claim 1, in which each latch member includes:

a latch pin mounted on said other peripheral member, a rotary member mounted on said latch pin for axial movement therealong and for rotation thereabout, a pressure arm fixed to and extending radially away from the rotary member, the pressure arm supporting said pressure component, linkage arm means fixed to and extending radially away from the rotary member, resilient means urging the rotary member to slide along the latch pin in the direction opposite said given direction, and spacer means establishing a limit to such sliding movement of the rotary member.

3. The door assembly claimed in claim 2, in which at least one of a) said pressure component and b) said compression member is wedge-shaped, such that as the pressure arm approaches a position corresponding to the first position of the latch member, the wedge shape acts in the manner of a cam, causing the gradual compression of said gasket means.

4. The door assembly claimed in claim 3, in which the compression member is wedge-shaped.

5. The door assembly claimed in claim 4, in which the pressure component is a freely rotating roller adapted to contact said compression member as the pressure arm approaches a position corresponding to the first position of the latch member.

6. The door assembly claimed in claim 1, in which said gasket means includes an internal gasket located between the interior flange of the first peripheral member and the inner flange of the second peripheral member, and an external gasket located between the exterior flange of the first peripheral member and the outer flange of the second peripheral member.

7. The door assembly claimed in claim 6, in which each latch member includes:

a latch pin mounted on said other peripheral member, a rotary member mounted on said latch pin for axial movement therealong and for rotation thereabout, a pressure arm fixed to and extending radially away from the rotary member, the pressure arm supporting said pressure component, linkage arm means fixed to and extending radially away from the rotary member, resilient means urging the rotary member to slide along the latch pin in the direction opposite said given direction, and spacer means establishing a limit to such sliding movement of the rotary member.

8. The door assembly claimed in claim 7, in which at least one of a) said pressure component and b) said compression member is wedge-shaped, such that as the pressure arm approaches a position corresponding to the first position of the latch member, the wedge shape acts in the manner of a cam, causing the gradual compression of said gasket means.

9. The door assembly claimed in claim 8, in which the compression member is wedge-shaped, and in which the pressure component is a freely rotating roller adapted to contact said compression member as the pressure arm approaches a position corresponding to the first position of the latch member.

10. The door assembly claimed in claim 1, in which said main door body is a composite structure which includes an inner core of foam material sandwiched between two outer skin layers of fibre reinforced material, said first peripheral member being of the same fibre reinforced material as said outer skin layers and integral therewith.

11. The door assembly claimed in claim 10, in which said second peripheral member is also of the same fibre reinforced material as said outer skin layers.

12. The door assembly claimed in claim 11, in which each latch member includes:

a latch pin mounted on said other peripheral member, a rotary member mounted on said latch pin for axial movement therealong and for rotation thereabout, a pressure arm fixed to and extending radially away from the rotary member, the pressure arm supporting said pressure component, linkage arm means fixed to and extending radially away from the rotary member, resilient means urging the rotary member to slide along the latch pin in the direction opposite said given direction, and spacer means establishing a limit to such sliding movement of the rotary member.

13. The door assembly claimed in claim 12, in which said compression member is wedge-shaped and the pressure component is a freely rotating roller mounted on said pressure arm and adapted to contact said wedge-shaped compression member as the pressure arm approaches a position corresponding to the first position of the latch member, whereby the wedge shape acts in the manner of a cam, causing the gradual compression of said gasket means.

14. The door assembly claimed in claim 13, in which said gasket means includes an internal gasket located between the interior flange of the first peripheral member and the inner flange of the second peripheral member, and an external gasket located between the exterior flange of the first peripheral member and the outer flange of the second peripheral member.

15. The door assembly claimed in claim 1, in which said operating means for the linkage assembly includes a shaft mounted on said other peripheral member for rotation and for longitudinal sliding movement, the shaft having inner and outer ends, the shaft being connected to a pinion gear which meshes with a slidable rack that is a component of said linkage assembly; an inner handle secured to the inner end of the shaft and an outer handle secured to the outer end of the shaft; said other peripheral member being configured to define a recess into which the outer handle can be received so that it lies substantially flush with the surrounding outer surface of said other peripheral member.

16. The door assembly claimed in claim 1, in which said plurality of spaced-apart compression members is secured to the interior flange of said first peripheral member, and in which the main door body and its first peripheral member are hingedly connected to the second peripheral member.

17. A door assembly comprising: a main door body; a first peripheral member extending around the perimeter of said main door body and secured thereto, said member defining a door flange extending generally away from the main door body; a second peripheral member in the form of a door frame adapted to surround the door body when the latter is in a closed position, the door frame defining a frame flange extending generally toward the main door body when the latter is in said closed position; a gasket between said two flanges, such that movement of the main door body in a given direction generally normal to the plane of the main door body causes compression of the gasket means, a plurality of spaced-apart compression members secured to one of the flanges; for each compression member, a latch member having a pressure component, the latch members being mounted on the other flange for movement between 1) a first position in which the pressure component presses against its respective compression member in a direction tending to move the main door body in said given direction, thus compressing the gasket means, and 2) a second position in which the pressure component does not press against its respective compression member; and a linkage assembly interconnecting all latch members and adapted to move the latch members in tandem between their respective first and second positions, the linkage assembly including operating means for operating the linkage assembly; each latch member including:

a latch pin mounted on said other flange, a rotary member mounted on said latch pin for axial movement therealong and for rotation thereabout, a pressure arm fixed to and extending radially away from the rotary member, the pressure arm supporting said pressure component, linkage arm means fixed to and extending radially away from the rotary member, resilient means urging the rotary member to slide along the latch pin in the direction opposite said given direction, and spacer means establishing a limit to such sliding movement of the rotary member.

18. The door assembly claimed in claim 17, in which at least one of a) said pressure component and b) said compression member is wedge-shaped, such that as the pressure arm approaches a position corresponding to the first position of the latch member, the wedge shape acts in the manner of a cam, causing the gradual compression of said gasket means.

19. The door assembly claimed in claim 18, in which the compression member is wedge-shaped.

20. The door assembly claimed in claim 19, in which the pressure component is a freely rotating roller adapted to contact said compression member as the pressure arm approaches a position corresponding to the first position of the latch member.

* * * * *